United States Patent [19]

Takahashi

[11] Patent Number: 4,925,424

[45] Date of Patent: May 15, 1990

[54] TOY VEHICLE AND TRACK WITH TRACK MOUNTABLE COMMAND SEGMENTS

[75] Inventor: Tokuo Takahashi, Tokyo, Japan

[73] Assignee: Kawada Co., Ltd., Tokyo, Japan

[21] Appl. No.: 209,141

[22] Filed: Jun. 17, 1988

[30] Foreign Application Priority Data

Jun. 17, 1987 [JP] Japan ..... 62-092126

[51] Int. Cl.[5] ..... A63H 30/00; A63H 17/40; A63H 30/02; E01F 9/00

[52] U.S. Cl. ..... 446/175; 446/441; 446/455; 404/9

[58] Field of Search ..... 446/175, 431, 436, 437, 446/438, 442, 441, 454, 455; 180/167, 169; 404/9, 12, 16

[56] References Cited

U.S. PATENT DOCUMENTS

| | | | |
|---|---|---|---|
| 2,074,251 | 3/1937 | Braun | 446/175 X |
| 3,739,179 | 6/1973 | Krekow | 404/16 X |
| 4,201,012 | 5/1980 | Marshall | 446/175 |
| 4,566,032 | 1/1986 | Hirooka et al. | 180/169 X |
| 4,658,928 | 4/1987 | Seo | 446/454 X |

FOREIGN PATENT DOCUMENTS

| | | | |
|---|---|---|---|
| 2749472 | 8/1978 | Fed. Rep. of Germany | 446/442 |
| 2539888 | 7/1984 | France | 180/167 |
| 2121741 | 1/1984 | United Kingdom | 180/167 |

*Primary Examiner*—Robert A. Hafer
*Assistant Examiner*—D. Neal Muir
*Attorney, Agent, or Firm*—Ladas & Parry

[57] ABSTRACT

A toy vehicle adapted to run on a track wherein the track defines a preselected pathway with a preselected geometrical configuration. A plurality of motion command modules are mounted at predetermined locations on the track and each motion command module has a detectable motion pattern array and the motion pattern array of each command module may be different than the other motion command modules. The toy vehicle has a motion producing device such as an electric motor for providing movement characteristics of the toy vehicle on the track in response to receipt of a motion control signal. A pattern detection unit is mounted on the vehicle and detects, for example, by optical detection, the detectable movement pattern array of each motion command module and generates the motion control signal in response thereto. The motion producing device, in response to receipt of the motion control signal may vary the speed or direction of the toy vehicle and, additionally, may vary the time duration of speed or speed changes as well as direction.

19 Claims, 6 Drawing Sheets

FIG. 2
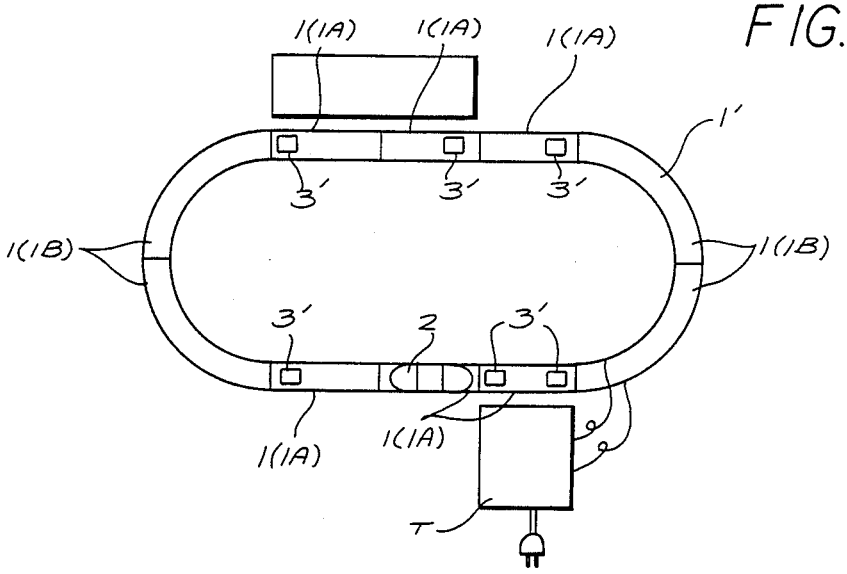
FIG. 3
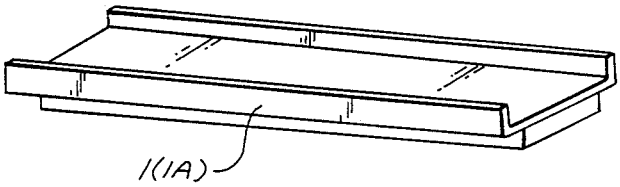
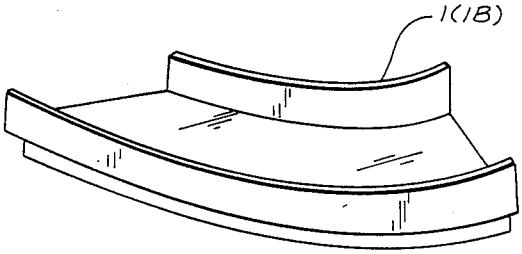
FIG. 5
FIG. 4
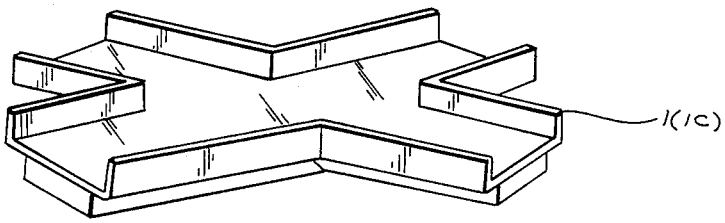

FIG. 6
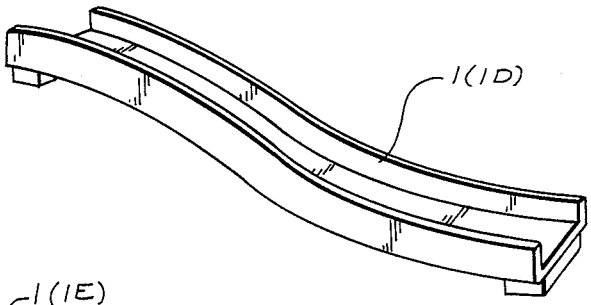
FIG. 7
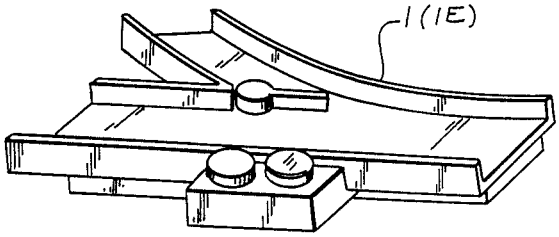
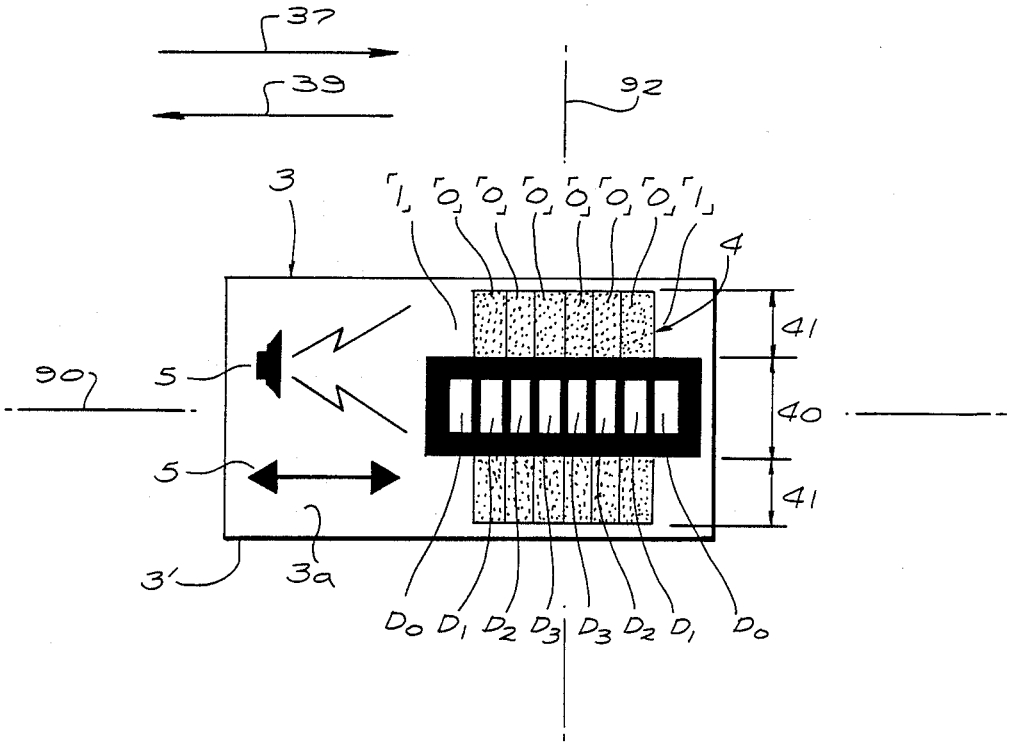
FIG. 8

FIG. 11

| CODE NO. | DATA POSITIONS IN THE PORTION OF THE STANDARD PATTERN SECTION 40 | | | | VISUAL INDICATION INDICIA 5 | FLASHING MODE OF LED 24 | OPERATIONAL MODE OF SPEAKER 25 | RUNNING MODE OF VEHICLE 2 (OPERATION MODE OF THE DRIVING MOTOR M) |
|---|---|---|---|---|---|---|---|---|
| | D3 | D2 | D1 | D0 | | | | |
| 0 | 0 | 0 | 0 | 0 | NONE | A | NONE | RUNNING |
| 1 | 0 | 0 | 0 | 1 | | A | B | RUNNING |
| 2 | 0 | 0 | 1 | 0 | 2c OFF | NONE | B | STOPPING AFTER PASSING TWICE |
| 3 | 0 | 0 | 1 | 1 | 4c OFF | NONE | B | STOPPING AFTER PASSING FOUR TIMES |
| 4 | 0 | 1 | 0 | 0 | | A | NONE | CHANGING THE RUNNING DIRECTION (MOTION CANCELLED ONCE) |
| 5 | 0 | 1 | 0 | 1 | 2c | A | NONE | CHANGING THE RUNNING DIRECTION AT THE SECOND PASSING (MOTION CANCELLED ONCE) |
| 6 | 0 | 1 | 1 | 0 | 3c | A | NONE | CHANGING THE RUNNING DIRECTION AT THE THIRD PASSING (MOTION CANCELLED ONCE) |
| 7 | 0 | 1 | 1 | 1 | 4c | A | NONE | CHANGING THE RUNNING DIRECTION AT THE FOURTH PASSING (MOTION CANCELLED ONCE) |
| 8 | 1 | 0 | 0 | 0 | 5s | B | A | PAUSING (5 SEC.) |
| 9 | 1 | 0 | 0 | 1 | 10s | B | A | PAUSING (10 SEC.) |
| A | 1 | 0 | 1 | 0 | 5s | B | A | PAUSING (5 SEC.); THEREAFTER, CHANGING THE RUNNING DIRECTION |
| B | 1 | 0 | 1 | 1 | 10s | B | A | PAUSING (10 SEC.); THEREAFTER, CHANGING THE RUNNING DIRECTION |
| C | 1 | 1 | 0 | 0 | 5c | A | NONE | REDUCING SPEED (5 SECONDS) |
| D | 1 | 1 | 0 | 1 | 10s | A | NONE | REDUCING SPEED (10 SECONDS) |
| E | 1 | 1 | 1 | 0 | 5s | A | C | REDUCING SPEED (5 SECONDS) |
| F | 1 | 1 | 1 | 1 | 10s | A | C | REDUCING SPEED (10 SECONDS) |

TOY VEHICLE AND TRACK WITH TRACK MOUNTABLE COMMAND SEGMENTS

BACKGROUND OF THE INVENTION

1. Field of the Invention

This invention relates to the toy art and in particular to a toy vehicle mounted on a track for preselected movement relative thereto.

2. Description of the Prior Art

Toy vehicles and in particular track mounted toy vehicles have long been known in the prior art. For example, electric trains of the type in which electricity is provided through the tracks to a motor mounted in a toy electric train which rides on the tracks. The power is provided through a transformer which can vary the amount of power provided to the electric motor and therefore vary the speed of the electric train. Other track mounted toy vehicles have the power supply for example, batteries, contained within the toy vehicle and have controls for providing speed variations therein. Further, various track configurations such as curves, reverse curves, "X" sections, right-angle cross-sections, and the like, have long been known for such track mounted toy vehicles. Such track sections may be interconnected to define various predetermined pathways having preselected geometrical configurations.

In many track mounted toy vehicle arrangements, however, it is often desired to provide preselected movements of the track mounted toy vehicle including stopping, starting, change in direction, change in speed, and varying the time duration for each of the characteristics. That is, for example, having a variable pause or stop time, various rates of acceleration or deacceleration, maintaining various speeds for various times, and the like. Further, for any given geometrical configuration of the track, it has often been desired to provide a plurality of movement characteristic changes throughout the pathway defined by the track. That is, at various positions on the track, the toy vehicle movably mounted thereon undergoes one or more of the above mentioned movement characteristics and/or movement changes.

Additionally, in many track mounted toy vehicle configurations, the toy vehicle not only is reversible that is, the toy vehicle may go forwards and in the opposite direction as a reverse but also the toy vehicle may be placed on the track so that forward may be in either direction with respect to the track. In such applications, of course, it is desired that the toy vehicle still undergo the movement characteristic changes as above described at each preselected location regardless of which direction is forward and which direction is reverse with respect thereto.

BRIEF DESCRIPTION OF THE INVENTION

Consequently, it is an object of the present invention to provide an improved track mounted toy vehicle.

It is another object of the present invention to provide an improved track mounted toy vehicle wherein the movement characteristics thereof are variable.

It is another object of the present invention to provide an improved track mounted toy vehicle arrangement in which the movement thereof is controlled at preselected positions of the track as the toy vehicle passes thereover.

It is another object of the present invention to provide an improved track mounted toy vehicle wherein changes in the movement characteristics of the toy vehicle on the track are automatically achieved at preselected locations on the track and independently of the direction of movement of the toy vehicle with respect thereto.

The above and other objects of the present invention are achieved, according to a preferred embodiment thereof, by providing a track means defining a preselected pathway having a preselected geometrical configuration. A toy vehicle means is mountable on the track means for relative movement thereon. If desired, the toy vehicle may be mountable on the track means for movement in opposite directions on the track means and, depending upon the placement of the toy vehicle on the track means, each direction may be forward and each direction may be reverse. The toy vehicle may, for example, simulate a locomotive and one or more cars simulating various types of train cars.

A motion producing means is mounted in the toy vehicle for providing preselected movement characteristics of the toy vehicle on the track means in response to receipt of a motion control signal. The motion producing means may comprise a electrically powered motor operatively connected to drive wheels of the toy vehicle which engage the track means and rotation of the drive wheels moves the toy vehicle with respect to the track means. The motion producing means may also comprise the source of electrical power provided to the electrical motor. As utilized herein the electrical power source may be batteries carried in the toy vehicle, a transformer connected to the track means for drawing electrical power from a remote source and providing the electrical power to the track means wherein, in turn, it is provided to the electrical motor of the toy vehicle, or any combination thereof or other acceptable configurations for providing motion of the toy vehicle means on the track means.

In general, for those toy vehicles that are powered by an electric motor, the motor is a variable speed motor and one in which the output speed of the motor and consequently the speed applied to the drive wheels varies depending upon the amount of electrical power that is provided to the electrical motor. This allows varying the speed of the toy vehicle with respect to the track means by varying the amount of electrical power. Such speed variations can, of course, cover the entire range from zero speed wherein no electrical power or insufficient electrical is provided to the electric motor to move the drive wheels to full power wherein the toy vehicle can accelerate to the maximum speed obtainable for the particular track configuration and condition. That is, if the track run up hill the maximum speed will, of course, be less at maximum power than if the track is level or the toy vehicle is going downwardly on a down slope of the track. The electrically powered variable speed motor above described are, in many applications, also reversible in direction so that, for example, by changing the polarity of the electrical power at the input to the electrical motor the direction of rotation of the output shaft and hence the direction of rotation of the drive wheels of the toy vehicle may be changed so the toy vehicle may be moved in both forward and reverse directions.

Motion command means according to the principles of the present invention are mountable on the track means and in detectable relationship to the toy vehicle for the condition of the toy vehicle passing in pattern detection relationship to the motion command means. The motion command means may be detachably mountable at a plurality of locations throughout the geometrical configuration of the track means and the motion command means may comprise a plurality of motion command units or modules. Each of the motion command modules may have a standard pattern section and a movement pattern section. The standard pattern section contains a detectable pattern array for example similar to the Uniform Pricing Code bar codes and a separate detectable movement pattern array which also may be similar to the Uniform Pricing Code bar codes. The detectable movement pattern array may be different for each of the movement command modules.

A pattern detection means is mounted on the toy vehicle and is operatively connected to the motion producing means such as the electric motor of the motion producing means. The pattern detection means detects both the standard pattern array and the detectable movement pattern array of each motion command module and generates a motion control signal in response thereto. The motion control signal that is generated by the pattern detection means is unique for each detectable movement pattern array. In preferred embodiments of the present invention each of the motion command modules is detachably mounted on the track means so that each individual module may be appropriately positioned at any of the plurality of mounting positions on the track means.

In preferred embodiments of the present invention each of the motion command modules contains a visual identification indicia which uniquely corresponds to the detectable movement pattern array.

As noted above, the pattern detection means may be an optical detection means such as those utilized in scanning the bar codes of the Universal Pricing Codes. Therefore, it may comprise an infrared radiation emission means and an infrared radiation detection means.

The motion producing means that responds to the receipt of the motion control signal generated by the pattern detection means may comprise, in addition to the structure as above set forth, a visual output signal means such as flashing lights which may for example be light emitting diodes (led), an audible signal output such as a small loud speaker, or the like. Such a visual and/or audible signal generating means provide enhanced play value to the toy vehicle arrangement of the present invention.

The visual identification indicia allows convenient identification of the particular movement characteristics that are varied by that particular motion command module.

BRIEF DESCRIPTION OF THE DRAWING

The above and other embodiments of the present invention may be more fully understood from the following detailed description taken together with the accompanying drawings wherein similar reference characters refer to similar elements throughout and in which:

FIG. 2 is a planned view of one embodiment of the present invention;

FIGS. 3 through 7 illustrate various track sections which may be joined together to define a particular pathway according to the principles of the present invention;

FIG. 8 illustrates a motion command module according to the principles of the present invention;

FIG. 11 is a table detailing the characteristics of a plurality of the motion command modules according to the principles of the present invention.

DESCRIPTION OF THE PREFERRED EMBODIMENTS

Figure 1:
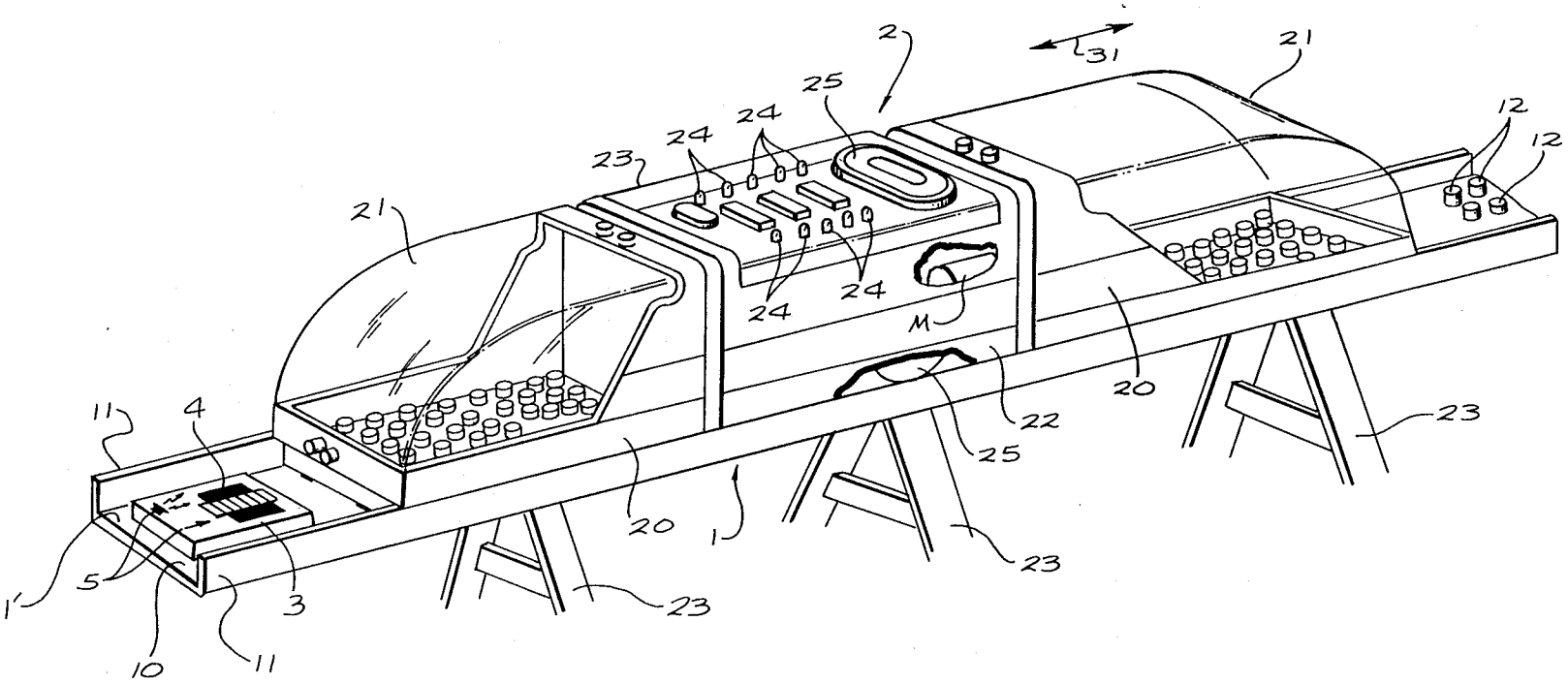
FIG. 1 is a perspective view of a preferred embodiment of the present invention.

Referring now to the Drawing there is illustrated in FIG. 1 a preferred embodiment of the present invention. As shown in FIG. 1 there is provided a track 1 consisting of the horizontal portion 10 and the vertical portions 11. It will be appreciated that the track means 1 may be of any desired type such as those having simulated railroad tracks with simulated ties therebetween and the like. In the track means 1 the vertical sides 11 are in spaced apart relationship and extend substantially the length of the track means 1. Mounting means 12 are provided on the horizontal running portion 10 of track means 1 and as shown in FIG. 1 the mounting means 12 comprise the cylindrical mounting protrusions as indicated at 12 extending upwardly from the horizontal running portion 10 and intermediate the side rails or vertical guides 11. The track means 1 may consist of various track portions coupled together to define a predetermined pathway having a preselected geometrical configuration.

As shown in FIG. 2 one such geometrical configuration is the roughly oval shape as indicated by 1' for the configuration. The track means 1 defining the oval shape 1' may be comprised of a plurality of track sections such as the six track sections 1A as shown in FIG. 3 arranged in the pattern as shown in FIG. 2 and four curved track sections 1B as shown in FIG. 4. Other geometrical configurations may be defined by the track means 1 in accordance with the principles of the present invention by utilizing other configured track sections such as the intersection 1C of FIG. 5, the sloped section 1D of FIG. 6, and the switching section 1E of FIG. 7. Other configurations of track sections may also be utilized in accordance with the principles of the present invention to define any desired geometrical configuration.

The mounting means 12 have been omitted from the track sections of FIGS. 3, 4, 5, 6 and 7 for clarity. The track 1 may be supported on supports as indicated at 23 in FIG. 1 either in whole or in part depending upon the particular configuration desired. It will be appreciated that the various track sections as above described are detachably connectable to each other in preferred embodiments of the present invention in order that a large variety of geometrical configurations of the track means 1 may be obtained.

Moveably mounted on the track means 1 is a vehicle means 2 moveable relative to the track means 1 in the directions indicated by the double ended arrow 31. The width of the toy vehicle 2 is approximately equal to or slightly narrower than the spacing between the vertical rails or guides 11 of the track means 1. The toy vehicle 2 in the embodiment illustrated in FIG. 1 is comprised of three cars. The front and rear cars 20 in the embodiment shown in FIG. 1 are generally the same and simulate a passenger car and driver's car and have transparent coverings 21 so that the inside of the cars may be seen. The front and rear cars 20 are generally similar in construction. The middle car 22 simulates a stylized locomotive which may, if desired, have a transparent covering 23 so that various components contained within the car 22, as described below, may be seen. The car 22 may contain an electric motor M operatively connected to drive wheel means 25 which engage the guides 11. Rotation of the motor M upon receipt of electric power rotates the drive wheels 25 to move the vehicle 2 on the track means 1.

As shown in FIG. 8, a motion command means 3 is illustrated which may be detachably mounted by mounting means 12 on the upper surface 10' of the horizantal portion 10 of the track 1 in a manner that it does not interfere with the running of the vehicle 2. The bottom surface of the motion command means 3 has apertures (not shown in the drawing) to receive, detachably, the cylindrical mounting means 12 of the track 1 as shown in FIG. 1.

A motion pattern area generally designated 4 is printed or otherwise provided on the upper surface 3*a* of the motion command means 3. The motion pattern area 4 consists of a standard pattern section 40 in the center and a movement pattern section 41 arranged on both sides of the standard pattern section 40. The standard pattern section 40 consists of a plurality, e.g. eight, of oblong cutouts [white portions in the drawing] which are regularly arranged in the direction of the running of the vehicle 2 in the directions indicated by the arrows 37 and 39. As shown in FIG. 8, positions of data in the cutouts are designated reading from either end as Do, D1, D2, D3, D3, D2, D1 and Do. The above-mentioned movement pattern section 41 is arranged on both sides of the standard pattern section 40 and has a portion corresponding to each of the eight data positions, D0, D1, D2, D3, D3, D2, D1 and D0. The black portion of movement pattern section 41 is a signal "0" and a cutout [white portion] is a signal "1". Thus, for example, the signals generated by the motion mode pattern section 41 shown in FIG. 8 are "1", "0", "0", "0", "0", "0", "0", and "1", from either end which corresponds to the data positions, D0, D1, D2, D3, D3, D2, D1 and D0, in the above-mentioned standard pattern section 40.

The standard pattern section 40 may be considered as divided into two portions: a first, unavailable area consisting of the first four data positions, D0, D1, D2 and D3, encountered by the vehicle from either end reading inwardly and an available area consisting of the second four data positions, encountered by the vehicle D3, D2, D1 and D0 reading from the middle to the end. As a result, in the standard pattern section 40 and the movement pattern section 41 shown in FIG. 8, the portion of the standard pattern section 40 with D0, D1, D2 and D3 consecutively constitutes the unavailable area and the portion with D3, D2, D1 and D0 consecutively constitutes the available area. For the vehicle 2 traveling on track means 1 from left to right in the direction of arrow 37, the digitalized signals "0", "0", "0" and "1" of the movement pattern array at 41 which correspond to the portion, D3, D2, D1 and D0, of the standard pattern array at 40 are detected as described below in detail. Similarly, for the vehicle 2 traveling on track means, from right to left in the arrowed direction of arrow 39, the portion having D0, D1, D2 and D3, consecutively, of the standard pattern section 40 from the right end constitutes the unavailable area and the portion having D3, D2, D1 and D0, consecutively from the middle out to the left end constitutes the available area. In this case, the digitalized signals, "0", "0", "0", and "1", of the movement pattern section 41 correspond to the portion from the middle to the left end having D3, D2, D1 and D0, of the standard pattern section 40 are recognized.

As shown above, there are eight data positions in the standard pattern section 40. In this embodiment, only four data positions, D3, D2, D1 and D0, from the middle to the end, depending upon the direction of the running of the vehicle 2 are used for recognizing and commanding signals in the movement pattern array at 41. The number of combinations of the four data positions, D3, D2, D1 and D0 of the standard pattern section 40 and signals "0" and "1" in the corresponding movement pattern section 41 is as follows:

$$2\times2\times2\times2=2^4=16$$

The vehicle 2 may, of course travel in either direction indicated by the arrows 37 and 39 regardless of the orientation of the vehicle 2 on the track means 11 if the motor M is a reversible motor. Accordingly, when the vehicle 2 runs in the direction of arrow 37, four data positions, D0, D1, D2 and D3, from the left end in the first portion of the standard pattern section 40 encountered by the vehicle 2 constitutes the unavailable area, and the portion having D3, D2, D1 and D0 from the middle to the right end constitutes the available area; however, when the vehicle 2 runs in the opposite direction shown by an arrow 39, the available area is the portion with four data positions, D3, D2, D1 and D0 from the middle to the left end and the four data positions, D0, D1, D2 and D3, of the first encountered portion of the standard pattern section 40 from the right end to the middle constitutes the unavailable area. As a result, although the combination of the four data positions, D3, D2, D1 and D0, in the available area of the standard pattern section 40 and signals "0" and "1" in the corresponding movement pattern array at 41 is 16 as shown above, the combination will be $16\times16=256$ when runs of the vehicle 2 in the direction of both arrows 37 and 39 are considered.

Accordingly, the number of combinations of the eight data positions, D0, D1, D2, D3, D3, D2, D1 and D0, of the standard pattern section 40 and signals "0" and "1" of corresponding movement pattern section 41 will be equivalent to $2^8=256$.

The standard pattern array indicated at 40 and the detectable movement pattern array indicated at 41 are optically detectable patterns and, therefore, may be similar to the Uniform Pricing Code bar codes now widely utilized on consumer products, and elsewhere.

Further, a plurality of motion command units 3' may be installed on the track means, at various locations, as shown on FIG. 2. Thus, the plurality of motion command units 3' comprise the motion command means 3 according to the principles of the present invention.

Although the standard pattern section 40 is arranged in the middle and the movement pattern section 41 is arranged on each side of the standard pattern section 40 in the above described example, it is possible that the movement pattern section 41 be arranged in the middle and the standard pattern section 40 arranged on each side of the movement pattern section 41.

A visual identification indicia means 5 is printed on the upper surface 3a of the motion command means 3 and said visual identification means 5 provides to the user a visual identification of the movement pattern of the vehicle 2 which results from the detection of the codes in section 4. The visual identification indicia means 5 is unique for each particular movement.

Figure 9:
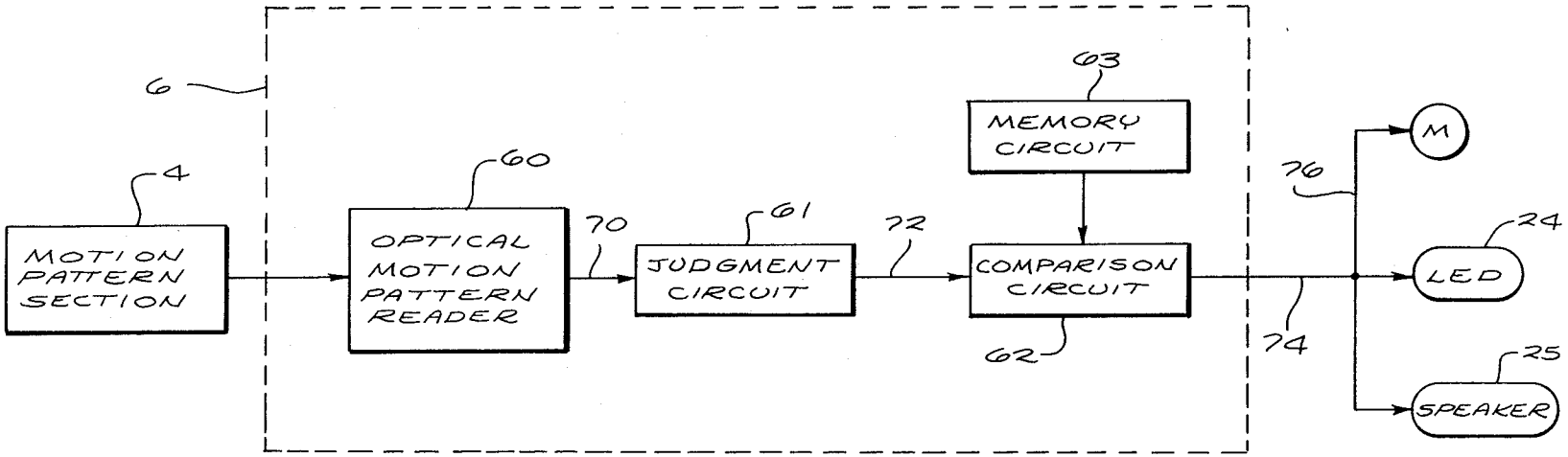
FIG. 9 is a block diagram of a pattern detection means according to the principles of the present invention.

A pattern detection means 6 is installed on the locomotive car 22 of the vehicle 2. The pattern detection means 6 comprises an optical motion-pattern reader 60, a judgment circuit 61, a comparison circuit 62 and a memory circuit 63 as shown in FIG. 9. The pattern detection means 60 detects the standard and movement pattern arrays on each motion command unit 3, and generates a motion control signal to the motion producing means in response to and corresponding to each detected pattern array of the detectable movement pattern array shown at 41.

Figure 10:
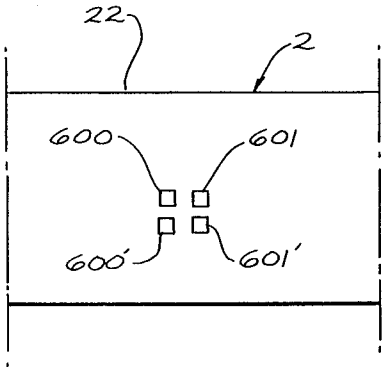
FIG. 10 is a block diagram illustrating certain portions of a pattern detection means according to the principles of the present invention.

The optical motion-pattern reader 60 is similar to the optical pattern scanners used in detecting the Uniform Pricing Code bar codes and comprises infrared ray emitting elements 600 and 600' and infrared receiving elements 601 and 601' and they are arranged on the bottom surface of the locomotive car 22 of the vehicle 2 to pass in pattern detection relationship to each motion command module or unit 3'. As shown in FIG. 10, the emitting element 600 and receiving element 601 for reading the standard pattern array at 40 are arranged in the center of the locomotive car 22 so that they face the standard pattern 40 on the motion command code units 3' which are attached to the track 1. Also, the emitting element 600' and receiving element 601' for reading the movement pattern section 41 are arranged adjacent to the emitting element 600 and receiving element 601 so that they face the movement pattern section 41 of the motion command units or modules 3' which are attached on the track 1. The optical motion-pattern reader 60 reads the standard pattern array at 40 and the movement pattern array at 41 which are on the upper surface 3a of the motion control means 3 attached on the track 1 and generates a first information output signal 70 in response thereto, and the first information output signal 70 is transmitted to the judgment circuit 61.

The judgment circuit 61 regards as invalid (unavailable) the signals of the movement pattern arrays at 41 which correspond to the data positions, D0, D1, D2, and D3, of the first encountered portion of the standard pattern section 40 which have been detected by the optical motion pattern reader 60. The judgment circuit 61 generates a second information output signal 72 which is fed to a comparison circuit 62 and corresponds to the detected movement pattern array at 41 corresponding to the data positions, D3, D2, D1 and D0, of the second encountered portion of the standard pattern section 40.

The comparison circuit 62 generates a third output information signal 74 which is fed to motion producing means 80 by motion control signal 76. The motion producing means 80 comprises the motor M, preferably an electric motor of variable speed depending on the power supplied thereto and which may also be a reversible motor, a plurality of light emitting diodes 24 and an audio speaker 25. The motion control signal 76, therefor, corresponds uniquely to the signal pattern of the motion command unit 3' which is detected by the optical motion pattern reader 60. The signal is also saved in the memory circuit 63.

The memory circuit 63 has the same number of motion command signal patterns as the motion command signal patterns of the movement pattern section 41 which is printed on the surface 3a of the motion command means 3.

In operation, when the power source such as transformer T is turned on, electrical power is provided to the motor M which drives the driving wheels thereby causing vehicle 2 to run on the track 1. Then, when the locomotive car 22 of the vehicle 2 reaches a motion command unit 3' which is attached on the track 1, the motion pattern section 4 which is printed on the motion command code unit 3' is read by the control circuit 6 which then outputs a motion control signal 76 corresponding to the detected motion pattern arrays in section 4 to the motor M, LED 24 and the speaker 25. The motor M, LED 24 and speaker 25 will operate according to the motion command signal 76. Accordingly, running modes (operation modes of the motor M) of the vehicle 2, flashing modes of LED 24 and audible signal modes of the speaker 25 can be electrically controlled by means of the motion pattern section 4 installed on the motion command means 3 and the control circuit 6 installed on the vehicle 2. Therefore, if a plurality of motion command units 3' with different pattern arrays 40 and 41 in motion pattern section 4 are arranged on the track 1 and the arrangement of said motion command code units 3' is changed from time to time, various and diversified running modes of the vehicle 2, flashing modes of LED 24 and audible signal modes of the speaker 25 are available.

Also, the structure is preferably designed so that each of the motion command units 3' can be attached to and detached from the track 1.

Further, since each motion command unit 3' is provided with a unique visual identification indicia 5 adjacent the motion pattern section 4 and corresponding thereto, the operating modes of the vehicle 2 which are based upon the detectable pattern arrays 40 and 41 of motion pattern section 4 can be visually recognized by means of said visual identification indicia 5. Accordingly, motion command units 3' on the track 1 can be rearranged easily and at the pleasure of users.

FIG. 11 is an explanatory table showing the relationship among the detectable signal pattern arrays of the movement pattern section 41 of the motion pattern section 4 of each motion command unit 3', the operation modes of the drive motor M of the vehicle 2, the flashing modes of LED 24, audible signal modes of the speaker 25 and the visual identification indicia 5 which provides visual identification of the operational modes of the vehicle 2.

It will be appreciated that the detectable movement pattern arrays of 41 are mirror images of each other about a longitudinal axis as indicated at 90. If desired, the movement pattern arrays of 41 may or may not be mirror images about a transverse axis 92, depending on the movement characteristics that are controlled to vary the operational status of the vehicle 2.

In Code No. 0, the movement pattern array at 41 is "0", "0", "0", and "0"; LED 24 flashes in Mode A; the speaker 25 is not activated; and the vehicle 2 continues running. In Code No. 1, the movement pattern array at 41 is "0", "0", "0" and "1"; LED 24 flashes in Mode A; the speaker 25 emits an audible signal having a Mode B; and the vehicle 2 continues running. In Code No. 2, the movement pattern array at 41 is "0", "0", "1" and "0"; LED 24 and speaker 25 operate in Mode B; and after the vehicle 2 passes this movement pattern array of 41 twice, the power source is turned off, thereby the vehicle 2 will stop. In Code No. 3, the movement pattern array at 41 is "0", "0", "1" and "1"; LED 24 is "Off"; the speaker 25 operates in Mode B; and after the vehicle 2 passes this movement pattern array at 41 four times, the power source is turned off, thereby the vehicle 2 will stop. In Code No. 4, the movement pattern array at 41 is "0", "1", "0" and "0"; LED 24 flashes in Mode A; the speaker 25 does not emit; and the driving motor M reverses, thereby the vehicle 2 changes the direction and runs in the opposite direction. In a similar manner for the remaining codes. In No. 5, the signals are "0", "1", "0" and "1"; LED 24 flashes in Mode A; the speaker 25 does not emit; and the vehicle 2 changes the direction of running after it has passed this movement pattern array at 41 twice. In No. 6, the signals are "0", "1", "1" and "0"; LED 24 flashes in Mode A; the speaker does not emit; and the vehicle 2 changes the direction of running after it has passed this movement pattern array at 41 three times. In No. 7, the signals are "0", "0", "1" and "0"; LED 24 flashes in Mode A; the speaker does not emit; and the vehicle 2 changes the direction of running after it has passed movement pattern array at 41 four times. In No. 8, the signals are "1", "0", "0" and "0"; LED 24 flashes in Mode B; the speaker 25 emits in Mode A; and the vehicle 2 pauses for 5 seconds. In No. 9, the signals are "1", "0", "0" and "1"; LED 24 flashes in Mode B; the speaker 25 emits in Mode A; and the vehicle 2 pauses for 10 seconds. In Code A, the signals are "1", "0", "0" and "1"; LED 24 flashes in Mode B; the speaker emits in Mode A; and the vehicle 2 changes the direction of running after it has paused for 5 seconds. In Code B, the signals are "1" "0", "1" and "1"; LED 24 flashes in Mode B; the speaker 25 emits in Mode A; and the vehicle 2 changes the direction of running after it has paused for 10 seconds. In Code C, the signals are "1", "1", "0" and "0"; LED 24 flashes in Mode A; the speaker 25 does not emit; and the vehicle 2 reduces the speed for 5 seconds. In Code D, the signals are "1", "1", "0" and "1"; LED 24 flashes in Mode A; the speaker does not emit; and the vehicle 2 reduces the speed for 10 seconds. In Code E, the signals are "1", "1", "0" and "0"; LED 24 flashes in Mode A; the speaker 25 emits in Mode C; and the vehicle 2 reduces the speed for 5 seconds. In Code F, the signals are "1", "1", "1" and "1"; LED 24 flashes in Mode A; the speaker emits in Mode C; and the vehicle 2 reduces the speed for 10 seconds.

The various modes of operation A, B and C for the LED 24 and speaker 25 may be selected to achieve any desired effect. The flashing of LED 24 may be fast or slow with flashes of various durations. The audible sounds emitted by speaker 25 may correspond to the particular operational characteristic of the vehicle 2 at any instant of time and may be electronically generated. Alternatively, other sound patterns may be used as desired.

As shown above, there are 16 operational modes for the vehicle 2 and the number [16] is the same as $2^4=16$ combinations of the signals "0" and "1" of the movement pattern array at 41 which correspond to the four data positions, D3, D2, D1 and D0, of the standard pattern section 40.

When these 16 different movement pattern arrays at 41 are combined with the direction of arrow 37, for example, and the direction of an arrow 39, for example, for the movement of the vehicle 2, $16\times16-256$ different movement pattern arrays at 41 can be obtained. The number [256] is the same as $2^8=256$ combinations of the signals, "0" and "1" of the movement pattern arrays at 41 which correspond to the eight data positions, D0, D1, D2, D3, D3, D2, D1 and D0, in the standard pattern section 40. Also, the judgment circuit 61 of the control circuit 60 does not read the signals of the movement pattern array at 41 which correspond to the first encountered data positions, D0, D1, D2 and D3, which is the unavailable area, of the standard pattern section 40; instead, it reads the signals of the movement pattern array at 41 which correspond to the second encountered data positions, D3, D2, D1 and D0, in the second encountered portion, which is the available area; therefore, no problems occur to the operation of the vehicle 2 in the directions indicated by the arrows 37 and 39.

Figure 12:
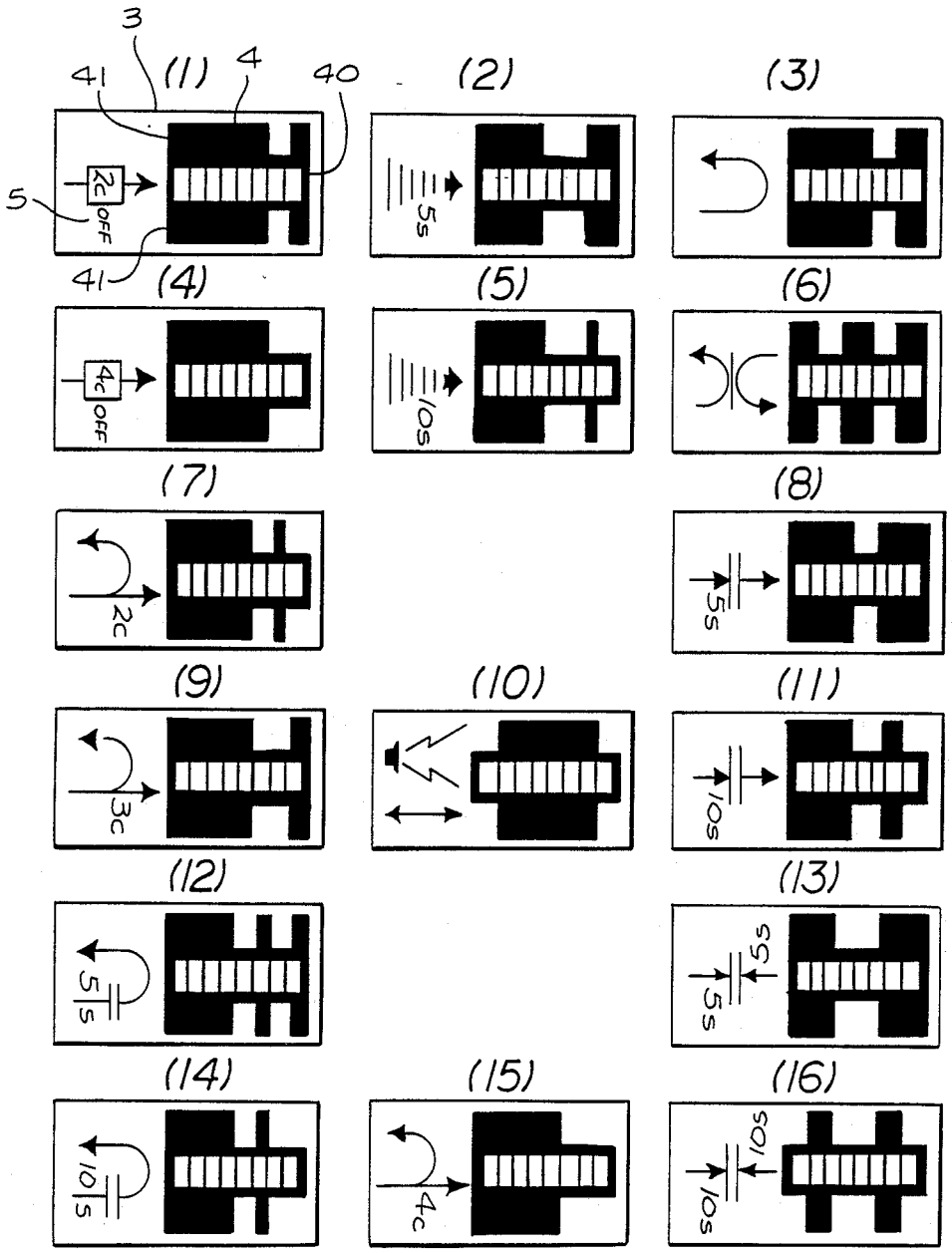
FIG. 12 illustrates 16 motion command modules according to the principles of the present invention.

FIG. 12 shows top surface views of motion command modules or units 3' with the motion pattern section 4 and the visual indication indicia 5 installed on them.

In the figure, (1) is the combination of the foregoing Code No. 0 and Code No. 2. (2) is the combination of Code No. 0 and Code No. C. (3) is the combination of No. 0 and No. B. (4) is the combination of No. 0 and No. 3. (5) is the combination of No. 0 and No. D. (6) is the combination of No. 4 and No. 4. (7) is the combination of No. 0 and No. 5. (8) is the combination of No. 0 and No. 8. (9) is the combination of No. 9 and No. 6. (10) is the combination of No. 1 and No. 1. (11) is the combination of No. 0 and No. 9. (12) is the combination of No. 0 and No. A. (13) is the combination of No. 8 and No. 8. (14) is the combination of No. 0 and No. B. (15) is the combination of No. 0 and No. 7. (16) is the combination of No. 9 and No. 9/

As shown above, if 16 different movement pattern arrays at 41 are combined respectively for the two directions indicated by arrows 37 and 39, 256 different motion modes can be obtained.

Although the data positions in the standard pattern 40 are set for eight as D0, D1, D2, D3, D3, D2, D1 and D0 and the eight data positions are divided into the first encountered portion and the second encountered portion in the foregoing working example, the number of data positions and divisions is not limite in that way.

The arrangement and shape of the standard pattern array at 40 and the movement pattern array at 41 of the motion pattern section 4 which is installed on the motion command units 3' are not limited to those shown in the figures of the drawing as long as they can be detected by the optical pattern reader 60 of the control circuit 6.

From the above, it can be seen that there has been provided an improved toy vehicle arrangement to provide a variety of operational modes of the toy while moving on a track. The appended claims are intended to cover all variations and adaptations falling within the true scope and spirit of the invention.

What is claimed is:

1. An improved toy vehicle arrangement comprising, in combination;

tracking means defining a predetermined pathway having a preselected geometrical configuration;

toy vehicle means positionable on said track means for relative movement thereon;

motion producing means on said vehicle for providing preselected movement characteristics of said vehicle on said track means in response to receipt of a motion control signal;

motion command means in spaced apart relationship to said toy vehicle mountable on said track means and in detectable relationship to said toy vehicle for the condition of said toy vehicle in pattern detection relationship to said motion command means, and said motion command means comprising:

a standard pattern section; and a movement pattern section; and said standard pattern section having a standard detectable pattern array and said movement pattern section having a detectable movement pattern array;

pattern detection means comprising electromagnetic radiation emitting and detecting means mounted on said toy vehicle and operatively connected to said motion producing means for selectively detecting said standard pattern array and said detection movement pattern array of said motion command means and generating said motion control signal in response thereto; and mounting means for mounting said motion command means on said track means.

2. The arrangement defined in claim 1 wherein:

said motion command means further comprises:

a visual identification indicia thereon corresponding to said detectable movement pattern array; and said pattern detection means comprises an optical pattern detection means.

3. The arrangement defined in claim 2 wherein:

said pattern detection means further comprises:

infrared radiation emission means; and infrared radiation detection means.

4. The arrangement defined in claim 3 wherein:

each of said standard pattern and said detectable movement pattern of said motion command means further comprises bar code type patterns.

5. The arrangement defined in claim 1 wherein:

said mounting means further comprises detachable mounting means.

6. The arrangement defined in claim 1 wherein:

said motion producing means further comprises:

an electrically powered motor; and means for providing electrical power to said electrically powered motor.

7. The arrangement defined in claim 6 wherein:

said motion control signal controls the amount of said electrical power provided to said electrically powered motor.

8. The arrangement defined in claim 7 wherein:

said motion control means further comprises:

light emitting means for emitting visual electromagnetic radiation in response to said motion control signal.

9. The arrangement defined in claim 8 wherein:

said motion control means further comprises:

audible signal emitting means for emitting predetermined audibly detectable signals in response to said motion control signal.

10. The arrangement defined in claim 1 wherein:

said motion command means comprises a plurality of motion command modules;

said mounting means provides a plurality of mounting positions on said track means for selectively mounting said motion command modules thereon.

11. The arrangement defined in claim 10 wherein:

each of said motion command modules have the same standard pattern array thereon.

12. The arrangement defined in claim 11 wherein:

each of said motion command modules have a unique detectable movement pattern array; and a unique visual identification indicia on each of said motion command modules corresponding to said detectable movement pattern array thereof.

13. The arrangement defined in claim 12 wherein:

said mounting means further comprises detachable mounting means.

14. The arrangement defined in claim 13 wherein:

said pattern detection means is an optical pattern detection means.

15. The arrangement defined in claim 14 wherein:

said pattern detection means further comprises:

infrared radiation emission means; and infrared radiation detection means.

16. The arrangement defined in claim 15 wherein:

each of said standard pattern array and said detectable movement pattern array of each of said motion command modules further comprises bar code type patterns.

17. The arrangement defined in claim 16 wherein:

said motion producing means further comprises:

an electrically powered motor; and means for providing electrical power to said electrically powered motor; and said motion control signal controls the amount of electrical power provided to said electrically powered motor.

18. The arrangement defined in claim 1 or 10 wherein:

said motion producing means further comprises:

means for varying the time duration of said preselected movement characteristics in response to said motion control signal.

19. The arrangement defined in claim 1 or 10 wherein:

said pattern detection means further comprises:

a standard pattern detection means for detecting said standard pattern arrays; and a movement pattern detection means for detecting said detectable movement pattern array.

* * * * *